US006247234B1

(12) United States Patent
Hill et al.

(10) Patent No.: US 6,247,234 B1
(45) Date of Patent: Jun. 19, 2001

(54) RAZOR AND BLADE

(76) Inventors: James L. Hill, 101 W. 147th St., New York, NY (US) 10039; Graham Walker, 269 W. 259$^{th}$ St., Bronx, NY (US) 10471

( * ) Notice: Subject to any disclaimer, the term of this patent is extended or adjusted under 35 U.S.C. 154(b) by 0 days.

(21) Appl. No.: 09/633,929

(22) Filed: Aug. 8, 2000

(51) Int. Cl.$^{7}$ ..... B26B 21/14; B26B 21/22

(52) U.S. Cl. ..... 30/34.1; 30/527; 30/531; 30/50

(58) Field of Search ..... 30/32, 34.05, 34.1, 30/62, 531, 47, 50

(56) References Cited

U.S. PATENT DOCUMENTS 3,964,160 * 6/1976 Gordon .
4,498,236 * 2/1985 McIntyre et al. .
5,761,812 * 6/1998 Feldman .
5,848,475 * 12/1998 Hill et al. .

* cited by examiner

*Primary Examiner*—Hwei-Siu Payer
(74) *Attorney, Agent, or Firm*—Hopgood, Calimafde Judlowe & Mondolino

(57) ABSTRACT

The invention provides a razor having a retaining mechanism assembly adapted to receive more than one blade with one of the blades being capable of lateral movement beyond the confines of the retaining mechanism assembly into a straight razor configuration. The retaining mechanism assembly has components for retaining and aligning the blades both within and beyond its confines. The retaining mechanism assembly has a pivotally attached handle to allow ergonomic adjustments to the shaving angle.

13 Claims, 10 Drawing Sheets

RAZOR AND BLADE

BACKGROUND OF THE INVENTION

This invention relates to a blade holder assembly of a razor, associated adjustable blades therein, and a blade dispenser.

SUMMARY AND OBJECTS OF THE INVENTION

In view of the foregoing, the present invention provides a razor useful for shaving that also facilitates shaving around hair, that is easier lo handle and manipulate than a straight razor, and yet which also has attributes of a straight razor that recall an earlier time in the habit of shaving.

The razor is preferably of a permanent (as opposed to disposable) construction so the user is presented with an assembled mechanism capable of shaving/styling facial hair.

This present invention provides a razor adapted to receive two blades with one in a fixed position and one blade capable of left or right lateral movement beyond the confines of the blade holder assembly. This invention provides, more particularly, a razor comprising a handle joined via a pivot to a retaining mechanism assembly, an adapter to receive and reasonably retain a blade in a manner suitable for shaving/styling. To further facilitate shaving/styling, the handle is ergonomically designed to extend out of the plane of the razor toward the cutting edge of the blade.

DETAILED DESCRIPTION OF SPECIFIC EMBODIMENTS

Figure 2A:
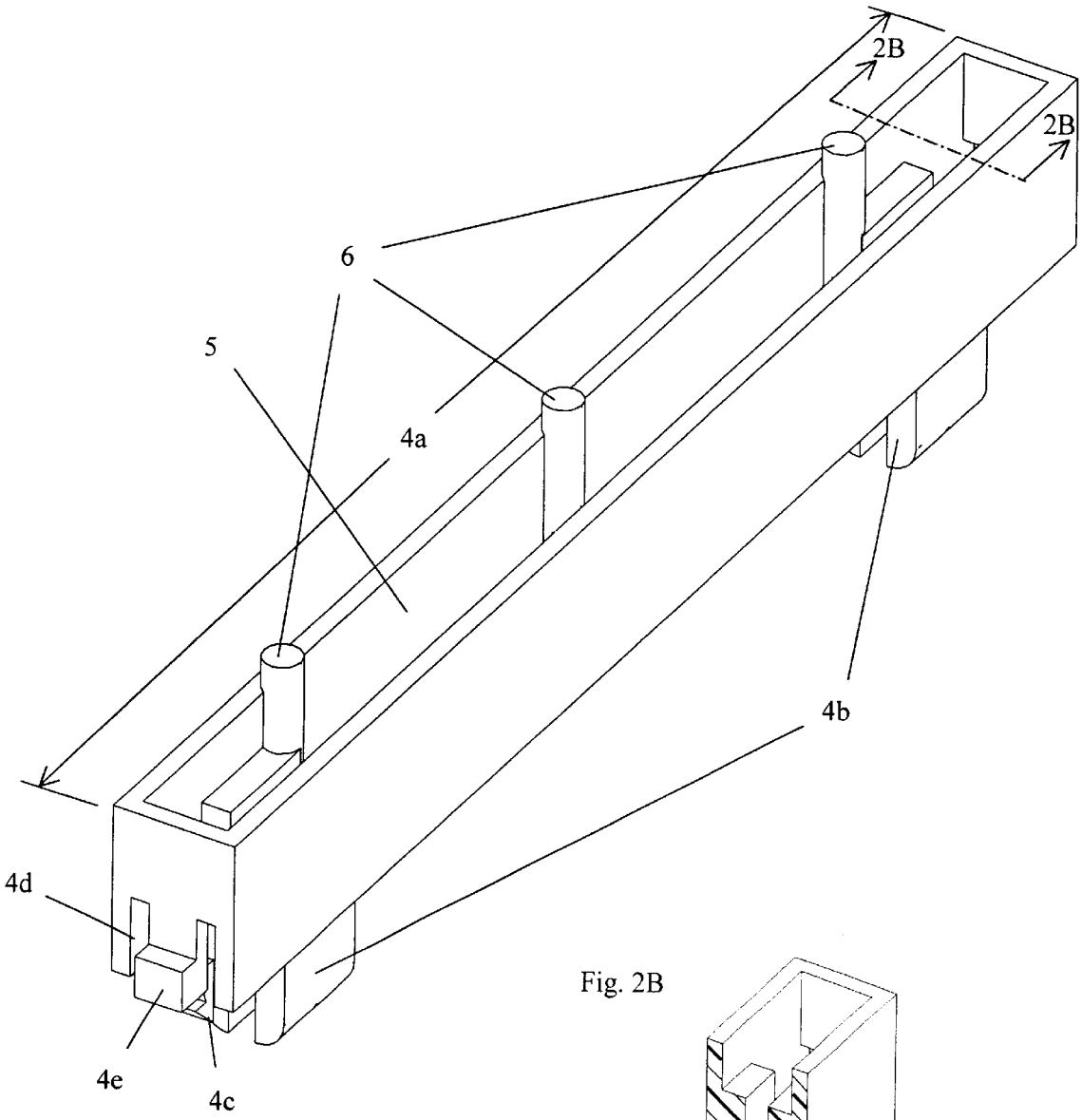
FIG. 2A and FIG. 2B is an isometric view of the blade holder support with a detail of the end section of the blade holder support.

In the following descriptions, parenthetical references are made to figures and the reference numerals therein, for example, element 5 in FIG. 2A is referenced as "FIG. 2A-5".

Figure 1:
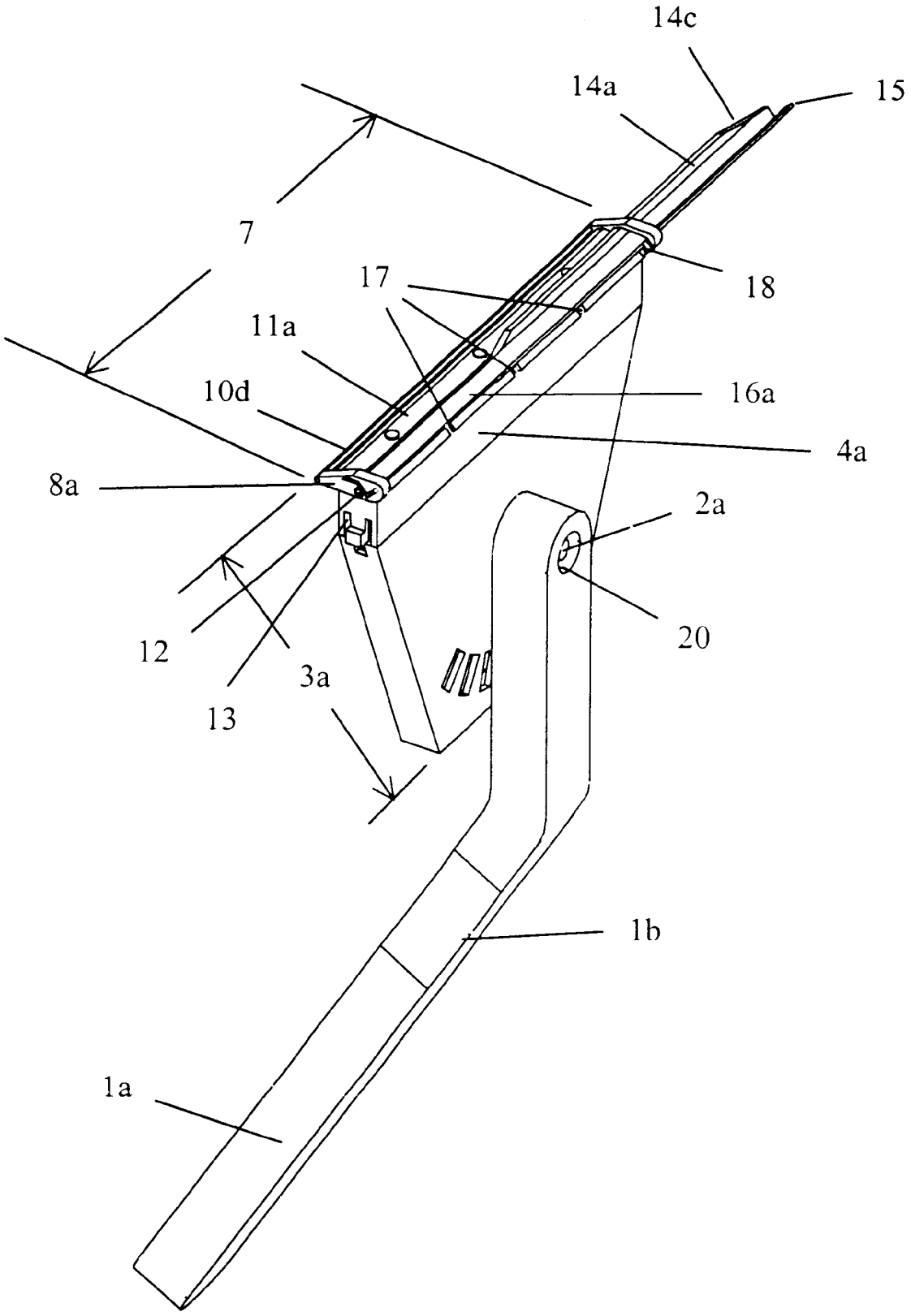
FIG. 1 is an isometric view of the blade holder assembly, the support on which it is mounted, the retaining mechanism on which such are mounted, and a handle pivotally attached thereto to provide a razor.

FIG. 1: Isometric View of the Back (i.e., the side facing the skin or hair being shaved/styled) of one embodiment of the razor which includes a handle (1*a*) joined to a retaining mechanism (3*a*) via the connecting pin (2*a*) through its handle aperture (20). The handle (1*a*) will preferably have at least one finger recess (1*b*) with optionally stippled grooves and a retaining mechanism assembly (3*a*) for blades for use in shaving/styling. The fixed blade (11*a*) is shown within the confines of the blade holder assembly (7). The styling blade (14*a*) is shown extending beyond the confines of the blade holder assembly (7). The styling blade also has chamfered ends (14*c*) to facilitate the trimming/styling of facial hair. The styling blade's lateral (i.e., left or right) movement is facilitated by the blade tabs (15) located on either end. The styling blade (14*a*) may exit the blade holder assembly (7) through either the styling blade holder end (FIG. 3A-10*b*) or the blade holder cap (FIG. 1-8*a*). The blade holder end (FIG.3A-10*b*) is molded to the safety bar (10d), the fixed blade (11*a*), the styling blade (14*a*), styling blade slot bar (16*a*), and locking pin (12). Motion holds (17) in the assembly base (FIG. 3A-16*b*) allow the styling blade (14*a*) to make secure stops at intermediate positions before the motion stops (18) contact the blade holder end (FIG. 3A-10*b*) or blade holder cap (8*a*), which blocks any further blade extension. The blade holder support (4*a*) supports the blade holder assembly (7).

FIG. 2A: Isometric View of the Blade Holder Support. This isometric view of the blade holder support shows its salient features. The blade holder support (4*a*) provides the base for the blade holder assembly (FIGS. 1–7). The blade posts (6) mate with the base apertures (FIG. 3A-9*b*) and the fixed blade aperture (FIG. 5-11*b*) to facilitate the alignment of the fixed blade (FIG. 5-11*a*) with the blade holder assembly (FIGS. 1–7). The load tabs (4*b*) are molded to the interior walls of the blade holder support (4*a*) and are designed to engage with the retaining mechanism (FIG. 9-3*b*) and provide a brace against any twisting torques. The support fastener (4*c*) is designed to releasably engage with the coupling aperture (FIG. 9-22*b*) of the retaining mechanism (FIG. 9- 3*b*). The push tab (4*e*) facilitates the disengagement of the support fastener (4*c*) from the coupling aperture (FIG. 9-22*b*). The blade holder vent (5) allows the passage of water through the retaining mechanism's drain vent (FIG. 9–24).

Figure 2B:
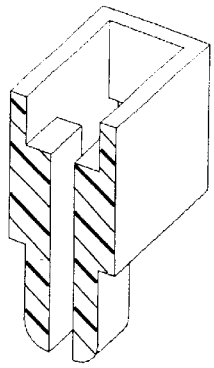

FIG. 2B: End Section of Blade Holder Support. This view displays the molded load tabs (4*b*) configured to the interior walls of the blade holder support (4*a*).

Figure 3A:
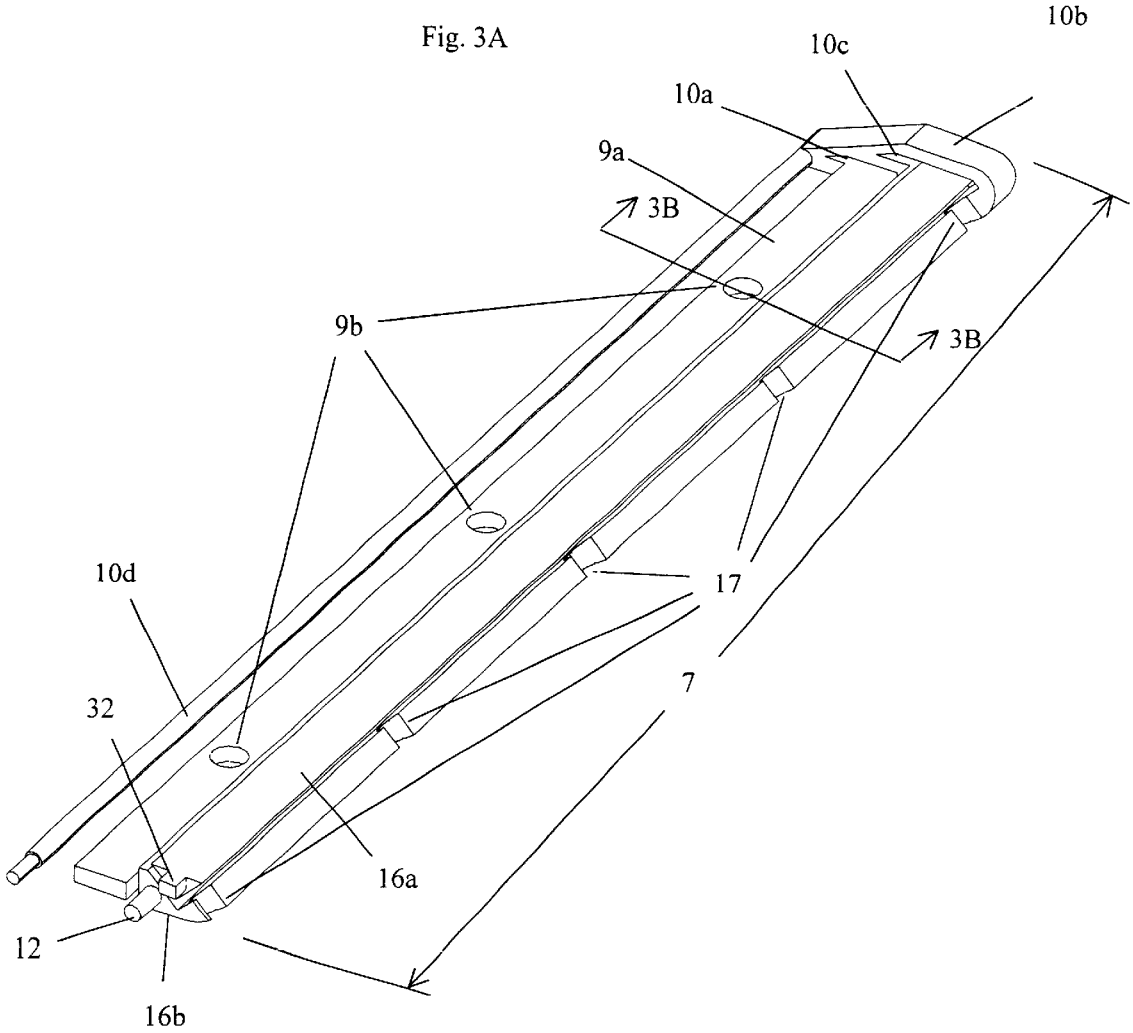
FIG. 3A and FIG. 3B is an isometric view of the blade holder assembly and detail of the blade holder end.
Figure 3B:
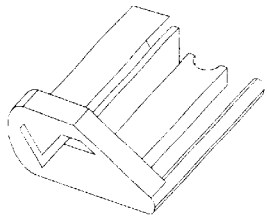

FIG. 3A: Isometric View of Blade holder Assembly Without Blades. The blade holder assembly (7) is a sub-assembly of the retaining mechanism assembly (FIG. 1-3*a*). The blade holder end (10*b*) preferably forms a single molding with the fixed blade base (9*a*), safety bar (10*d*), locking pin (12), styling blade slot bar (16*a*) and assembly base (16*b*). The fixed blade base (9*a*) provides the base for the fixed blade (FIG. 5-11*a*) and is configured to the fixed blade cap slot (10*a*). The fixed blade base (9*a*) has base apertures (9*b*) that accept the blade posts (FIG. 2A-6) and thereby stabilize the fixed blade (FIG. 5-11*a*). The styling blade bar (16*a*) is configured to the styling blade slot (10*c*), which is designed to receive the styling blade (FIG. 6-14*a*). Motion holds (17) allow the locking protrusions (FIG. 6-14*b*) to adopt an intermediate position prior to each of the motion stops (FIG. 6–18) encountering the blade holder end (10*b*) or blade holder cap (FIG. 1-8*a*). The safety bar (10*d*) is positioned in front of the fixed blade base (9*a*) and engages with the safety bar aperture (FIG. 4A-8*b*). The locking pin (12) engages with the locking pin aperture (FIG. 4A-19) to allow the blade holder cap (FIG. 4A-8*a*) to be securely attached to the blade holder assembly (7).

The cap locator (32) is an extension on the styling blade slot bar (16*a*) that mates with the cap locator aperture (FIG. 4A-33) to prevent flexing of the styling blade slot bar (16*a*).

Figure 4A:
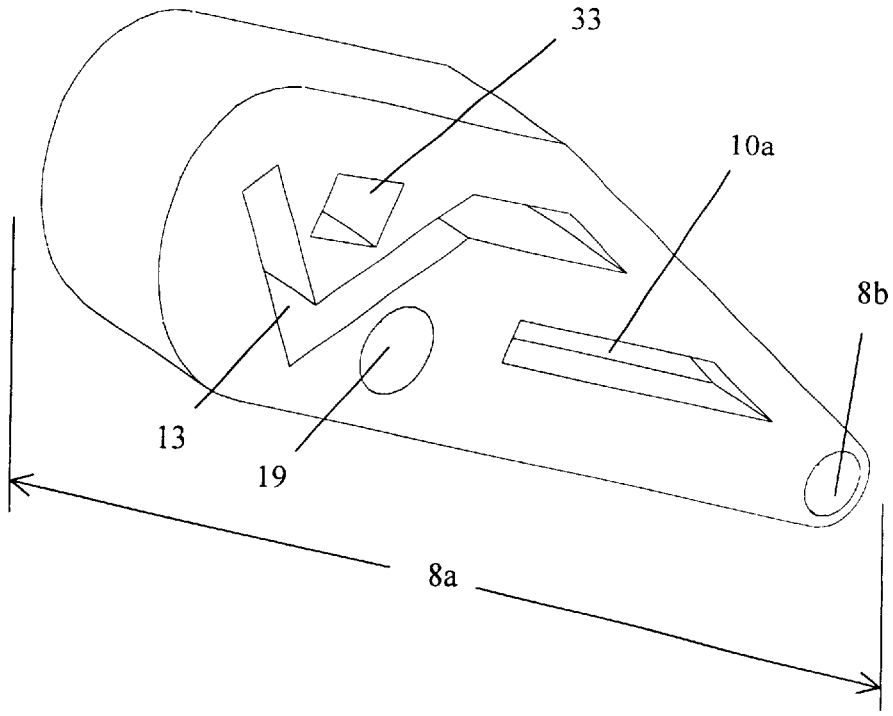
FIGS. 4A and 4B are isometric views of the inside and outside of a blade holder cap.

FIG. 4A: Isometric View of Inside Blade Holder Cap. This view of the blade holder cap (8*a*) shows an inside view of the mating apertures (i.e., safety bar aperture (8*b*) and locking pin aperture (19)) and slots (i.e., fixed blade cap slot (10*a*) and styling blade cap slot (13)), which are designed to engage with the associated elements of the blade holder assembly.

Figure 4B:
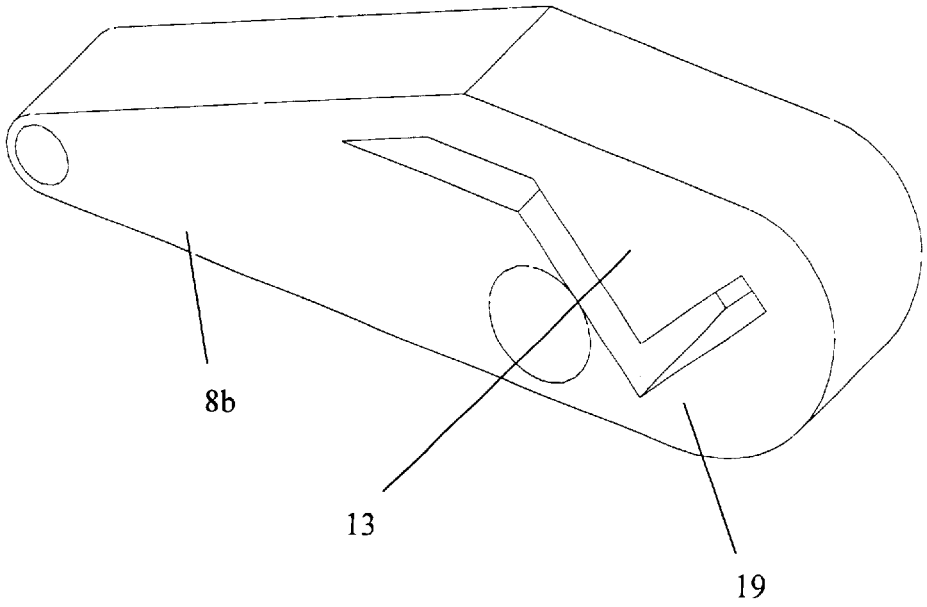

FIG. 4B: Outside Isometric View of Blade Holder Cap. This view of the blade holder cap (8*a*) shows the safety bar aperture (8*b*), locking pin aperture (19), and the styling blade cap slot (13), which allows the styling blade (FIG. 6-14*a*) to extend beyond the body of the blade holder assembly (FIGS. 1–7). The locking pin aperture (19) is also conical in shape allowing the locking pin (12) to be turned over, thereby securing the blade holder cap (FIG. 4A-8*a*) to the blade holder assembly (FIGS. 3A-7).

Figure 5:
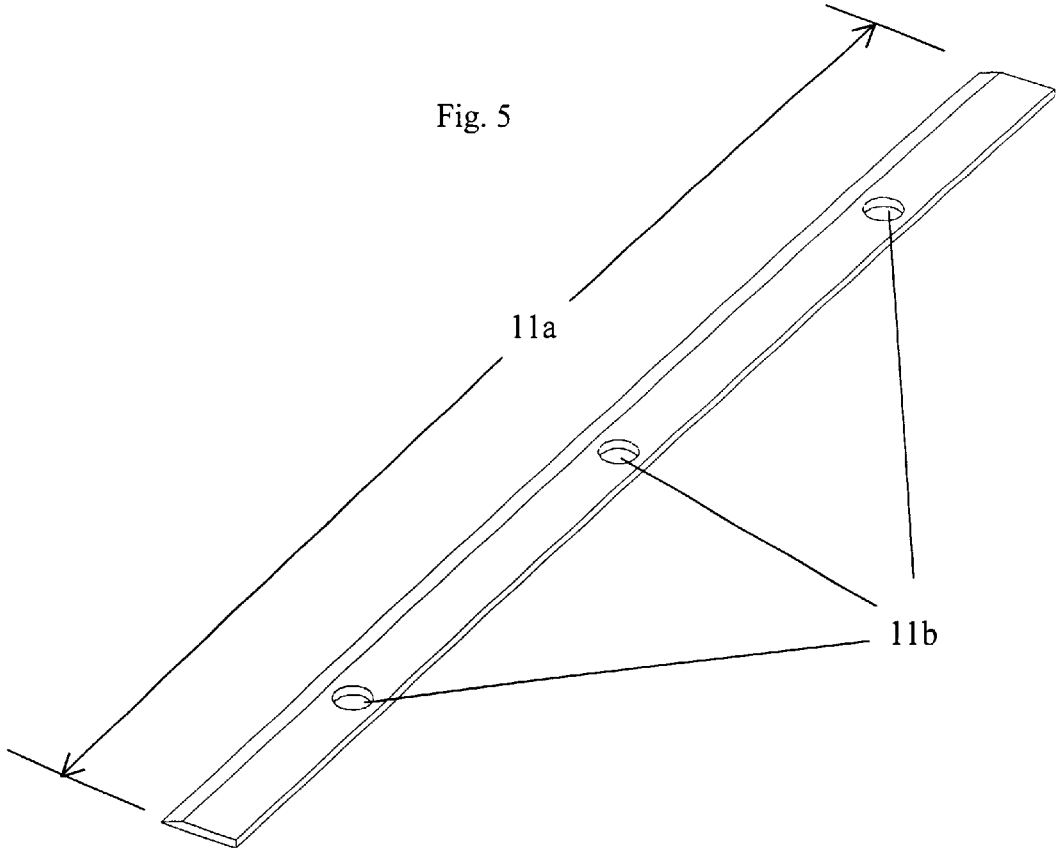
FIG. 5 is an isometric view of the fixed blade portion of the device.

FIG. 5: Isometric View of Fixed Blade. This view of the fixed blade (11*a*) shows that it is a flat blade with a number of fixed blade apertures (11*b*) located along the blade.

Figure 6:
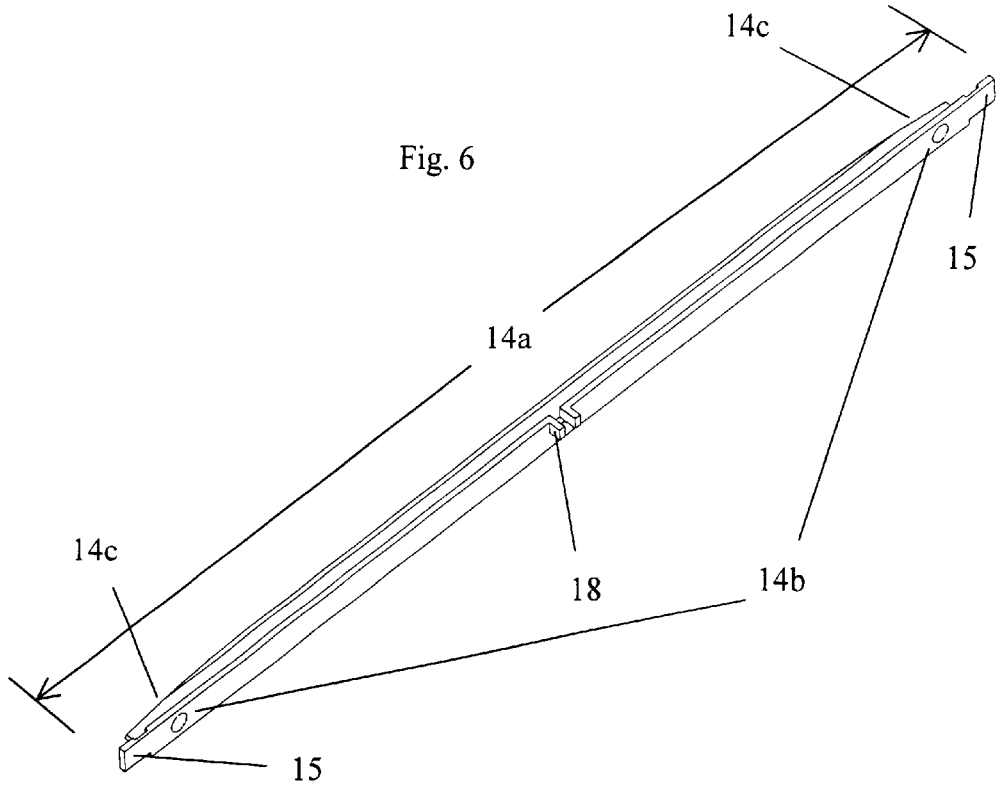
FIG. 6 is an isometric view of the slidable styling blade.

FIG. 6: Isometric View of Styling Blade. The styling blade's (14*a*) shape is designed to allow the blade to slide laterally along the styling blade slot bar (FIG. 3A-16*a*) and through either side of the styling blade cap slot (FIG. 4A-13). This motion is facilitated by use of the blade tabs (15). The locking protrusions (14*b*) allow the blade to securely lock into intermediate positions before the motion stops (18) hit the blade holder end (FIG. 3A-11*b*) or the blade holder cap (FIG. 4A-8*a*), thereby limiting the lateral motion of the blade. The chamfered blade ends (14*c*) are cut at a shallow angle to allow the main body of the razor to be held away from the face while at the same time allowing facial hair to be styled/trimmed. The blade can be designed to be slid out any amount (until the motion stop hits the blade holder cap or blade holder end), and preferably is from about one-half of its extent (i.e., end to end distance) to about one-third of its extent (e.g., three-eighths of its extent extends beyond the blade holder cap or blade holder end).

Figure 7A:
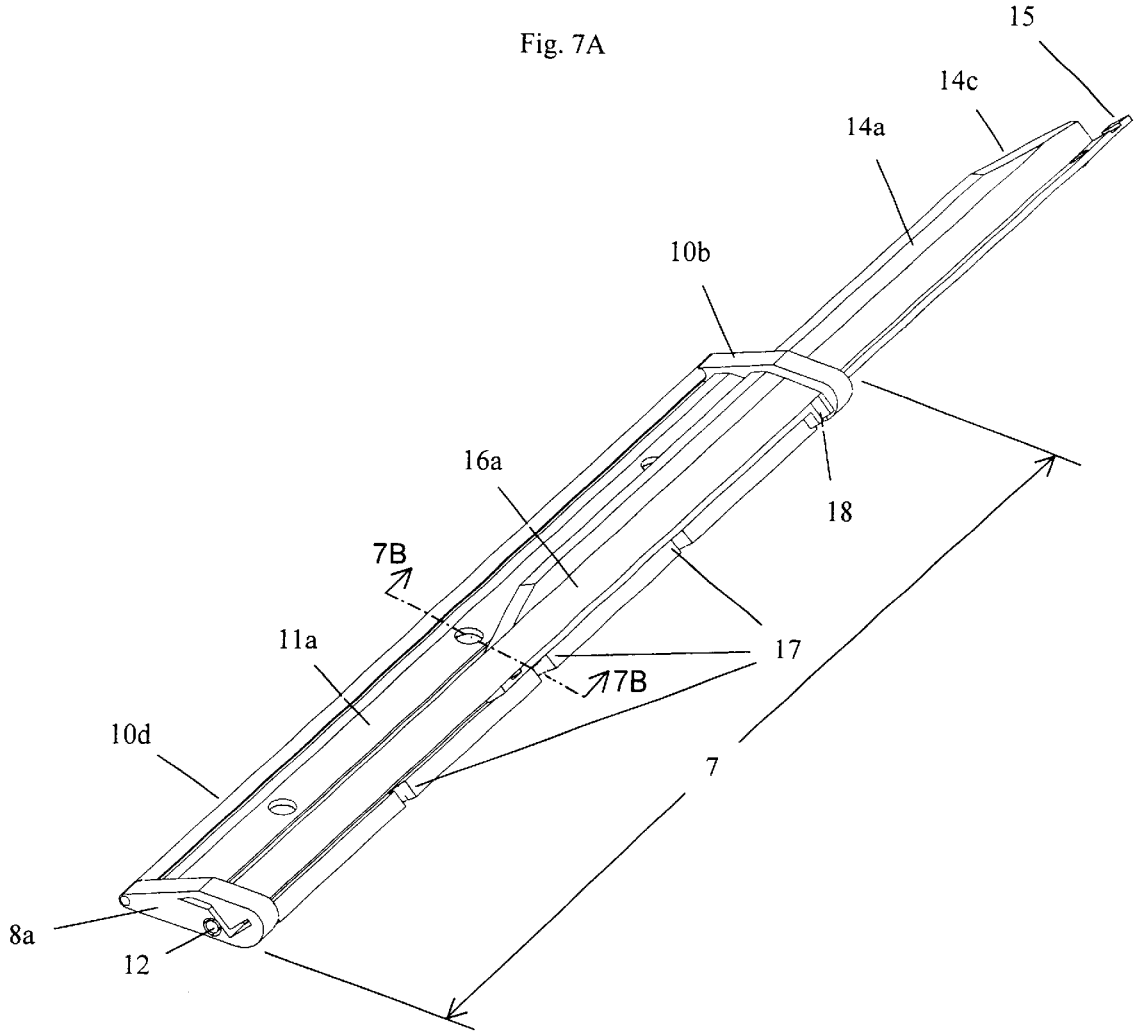
FIG. 7A is an isometric view of the blade holder assembly with blades, including the styling blade having been slide to extend out to one side.

FIG. 7A: Isometric View of Blade Holder Assembly with Blades. This view of the blade holder assembly (FIG. 7A) differs from the previous view of the blade holder assembly (FIG. 3A) in that it shows the assembly with the fixed blade (11*a*), and styling blade (14*a*) in place. The blade holder cap (8*a*) is also shown attached to the blade holder assembly (7) via the safety bar (10*d*), and locking pin (12), which is turned over to hold the blade holder assembly securely in place.

Figure 7B:
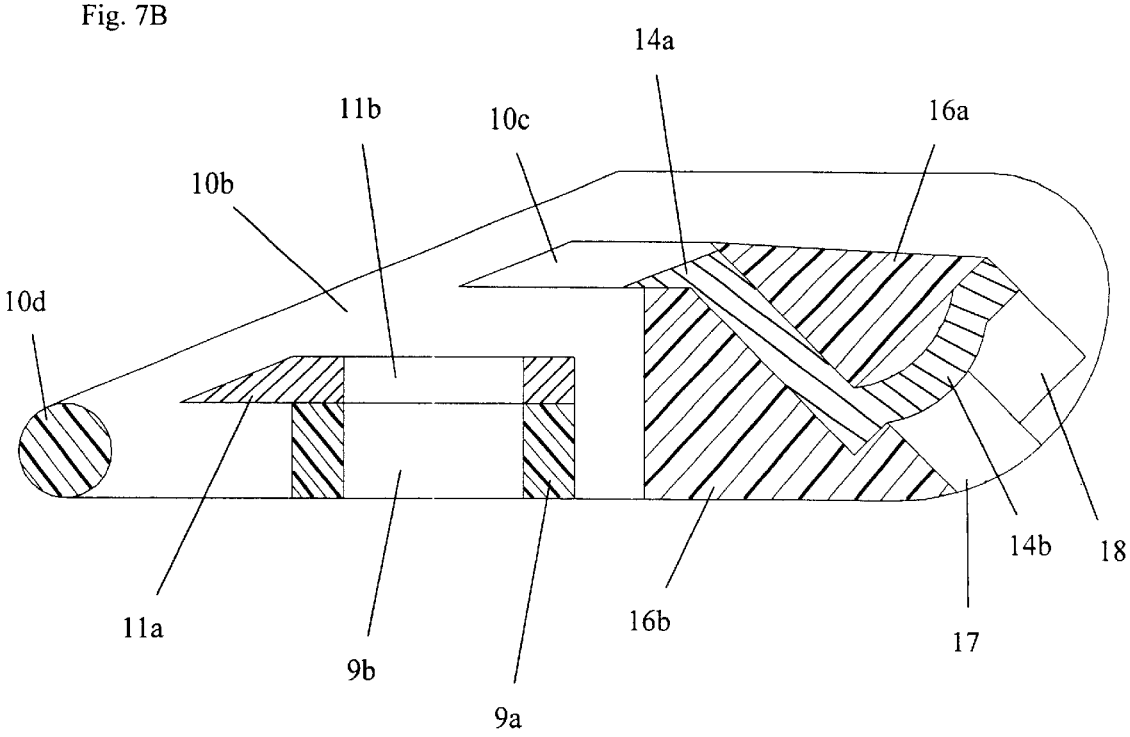
FIG. 7B is a cross sectional view taken through line A—A in FIG. 7 through one of the motion stops, the holder assembly including the fixed blade, and the styling blade.

FIG. 7B: Cross Section of the Blade Holder Assembly. This view shows the cross section of the blade holder assembly shown in FIG. 7A along cut line A—A, which passes through the central base aperture. This figure illustrates how the fixed blade (11*a*) and styling blade (14*a*) marry with the blade holder assembly, and how the locking protrusion (14*b*) nests with the motion hold (17). This figure also shows how the fixed blade aperture (11*b*) aligns with the base aperture (9*b*). The safety bar (10*d*), fixed blade base (9*a*), and assembly base (16*b*) can be formed from a single molding with the blade holder end (10*b*). The motion stop (18) is also shown abutting to the blade holder end (10*b*). The styling blade (14*a*) fits between the styling blade slot bar (16*a*) and the assembly base (16*b*), and passes through the styling blade slot (10*c*) in the assembly end. Working from the front to the rear, the four elements seen are the safety bar (10*d*), the fixed blade base (9*a*), the assembly base (16*b*), and the styling blade slot bar (16*a*).

Figure 8A:
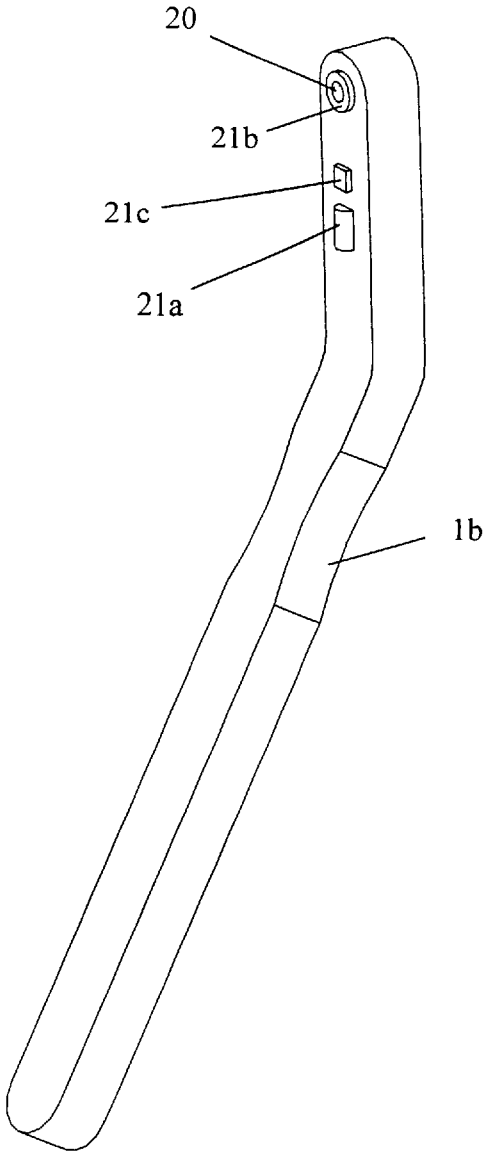
FIGS. 8A and 8B are, respectively, front and rear views of embodiments of the handle shown in FIG. 1.
Figure 9:
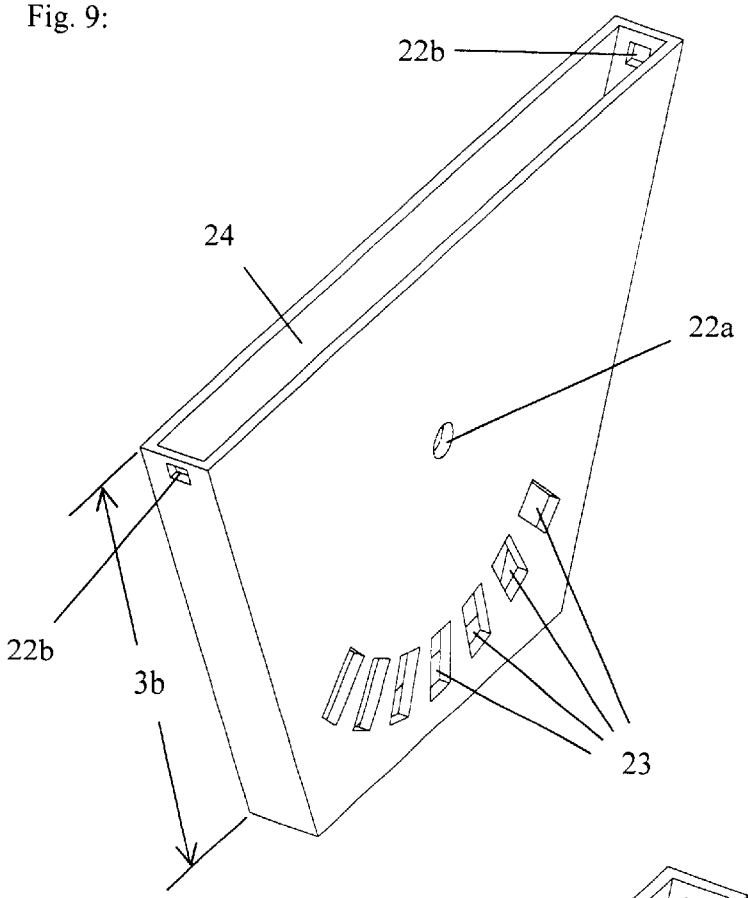
FIG. 9 is a isometric view of the retaining mechanism shown in FIG. 1.

FIG. 8A: Isometric View of Handle. The handle (FIG. 1-1*a*) here has preferably one or more finger recess (1*b*) with optionally stippled grooves. The handle aperture (20) is encircled by a thrust washer (21*b*) molded into the handle to facilitate the rotational positioning of the seating groove positioner (21*a*) while the load pad (21*c*) relieves the stress on the seating groove positioner (21*a*).

Figure 8B:
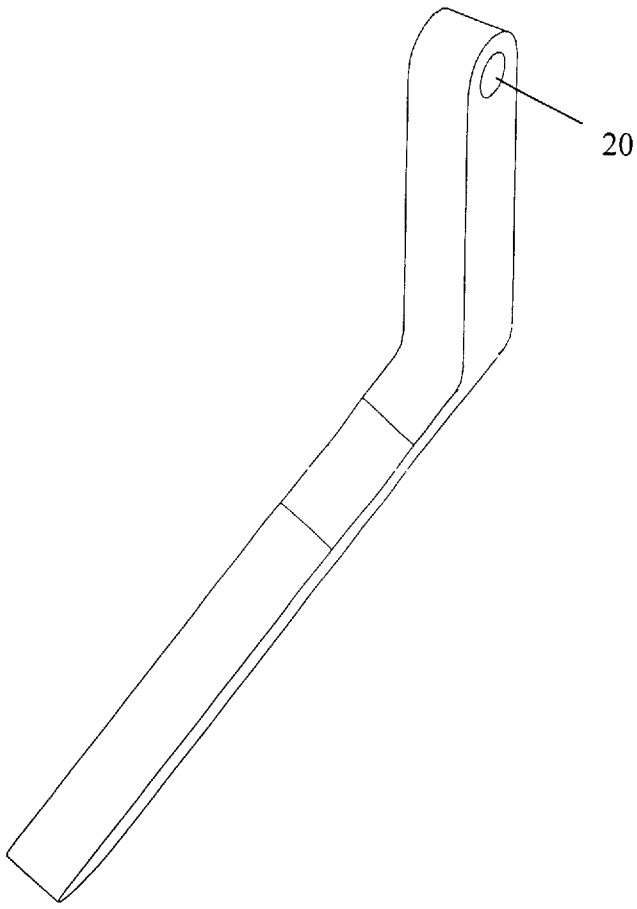

FIG. 8B: Isometric View of the Handle Back. Another view of the handle aperture (20) is shown.

FIG. 9: Isometric View of Retaining Mechanism. This view of the retaining mechanism (3*b*) shows how the handle (FIG. 1-1*a*) is connected to this mechanism and the user's ability to position it. The detailed mechanics are set forth in FIG. 10.

Figure 10:
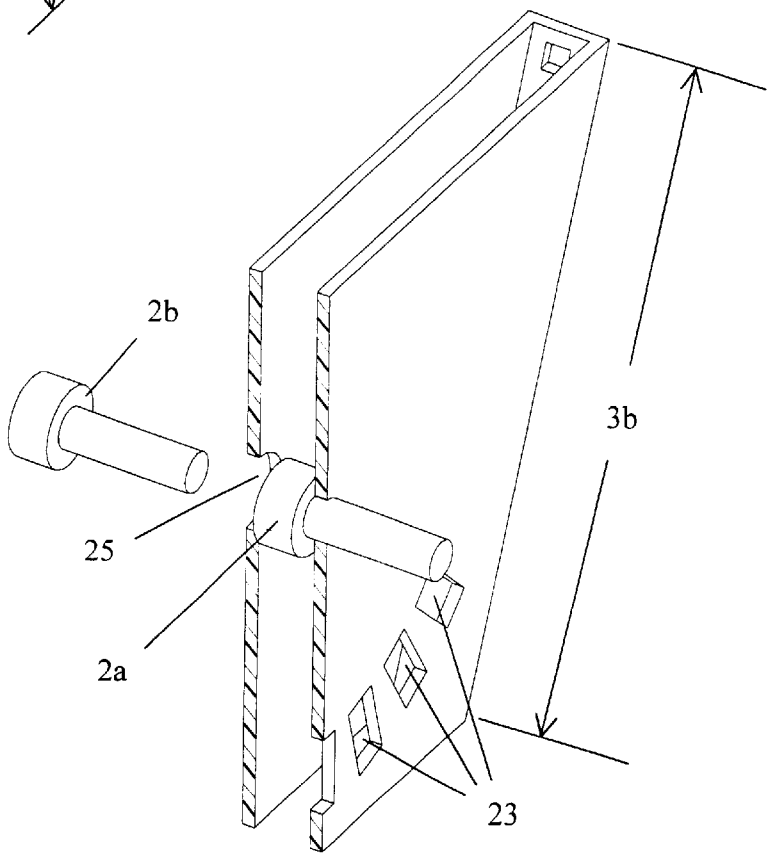
FIG. 10 is a partially exploded, cross sectional view of the retaining mechanism shown in FIGS. 1 and 9, including the pin (2*a*) connecting the pivotal handle thereto.

FIG. 10: Cross-section of the Retaining Mechanism. The retaining mechanism (3*b*) provides the base for the blade holder assembly (FIGS. 1–7). The support fasteners (FIG. 2-4*c*) engage with the coupling apertures (FIG. 9-22*b*) to join the blade handle assembly (FIGS. 1–7) to the retaining mechanism (3*b*). The retaining mechanism aperture (FIG. 9-22*a*) is aligned to the handle aperture (FIG. 8A-20) and is secured by inserting the connecting pin (2*a*) through the pin access aperture (25). The handle's seating groove positioner (FIG. 8-21*a*) mates with the seating grooves (23) facilitating the selected positionings. The retaining mechanism drain vent (FIGS. 9–24) allows the continued passage of the excess moisture to exit the mechanism.

Figure 11A:
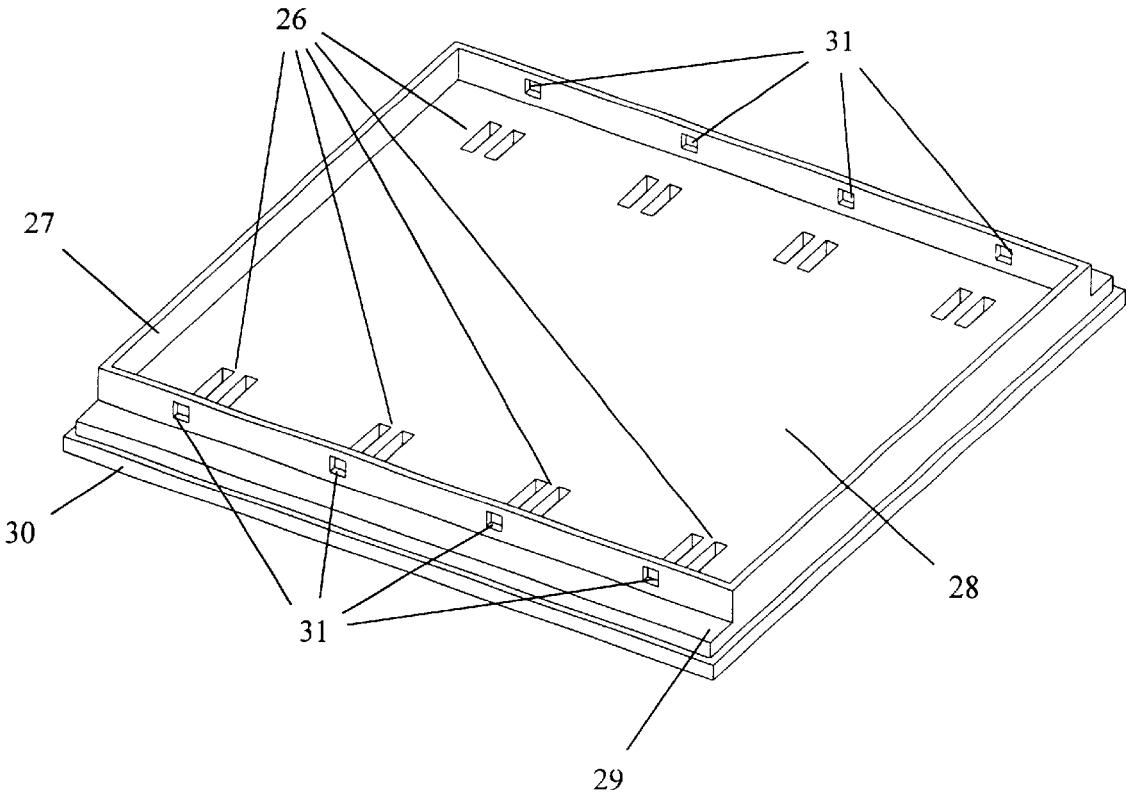
FIGS. 11A and 11B are, respectively, isometric views of a blade dispenser alone, and with a combined replacement blade holder assembly and support thereof.
Figure 11B:
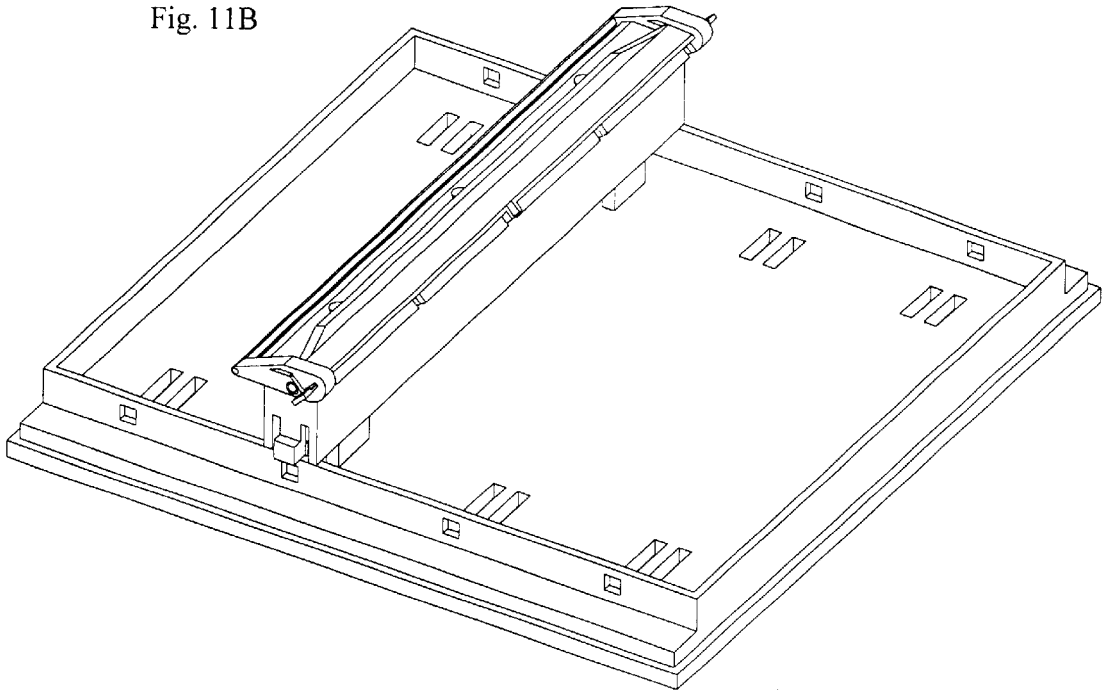

FIG. 11A: Blade Dispenser and FIG. 11B: Blade Dispenser with Blade Holder Support and Assembly. The blade dispenser is designed to allow the combined blade holder support (FIG. 2A-4*a*) and blade holder assembly (FIG. 7—7) to be positioned, and removed, from the dispenser. The alignment holes (26) in the dispenser base (28) facilitate the seating and unseating of the load tabs (FIG. 2A-4*b*). The snap holes (31) in the holder walls (27) facilitate the securing of the blade holder support (FIG. 2A-4*a*) by providing locations for the support fasteners (FIG. 2-4*c*) to lock into place. The push tabs (FIG. 2-4*e*) can then be used to disengage the blade holder support from the dispenser. A spacing lip (29) and cover lip (30) complete the dispenser's design. The cover lip (30) provides a land for any cover that may be needed to encase the four blade assemblies.

The foregoing description is meant to be illustrative and not limiting. Various changes, modifications, and additions may become apparent to the skilled artisan upon a perusal of this specification, and such are meant to be within the scope and spirit of the invention as defined by the claims. For example, with present razor companies selling multiple fixed blade razors (e.g., twin blade, triple blade), it should be understood that the present razor can have more than one fixed blade.

What is claimed is:

1. A razor, comprising:

a blade holder assembly having a longitudinal extent with opposing sides, a front end for engaging a shaver's face, and a rear end;

a safety bar at the front end of the blade holder assembly;

a fixed blade mounted on the blade holder assembly rearwardly of the safety bar; and a styling blade mounted on the blade holder assembly rearwardly of said fixed blade and adapted to be slidably positionable along said longitudinal extent of said blade holder assembly and, when slid, to protrude from one or the other of said opposing sides, and when centered in said blade holder assembly the styling blade is exposed and functions as a primary shaving blade in cooperation with said fixed blade to form a twin blade razor.

2. The razor of claim 1, wherein the styling blade has an extent essentially equal to the longitudinal extent of said holder assembly.

3. The razor of claim 2, wherein the styling blade is slidable so that up to about one-half of its extent protrudes from one or the other of said opposing sides.

4. The razor of claim 1, further comprising a blade holder support on which said blade holder assembly is mounted.

5. The razor of claim 4, further comprising a retaining mechanism assembly on which said combined blade holder assembly and blade holder support are removably attached.

6. The razor of claim 5, further comprising a handle pivotally mounted to said retaining mechanism assembly.

7. The razor of claim 1, wherein said styling blade is disposed between an aperture defined by an assembly base and a slot bar of the razor.

8. The razor of claim 4, wherein said fixed blade comprises a plurality of bores, and wherein said blade holder support comprises a corresponding plurality of posts allowing said blade holder assembly to be mounted on said blade holder support.

9. The razor of claim 7, wherein said base comprises a plurality of motion hold recesses, and said styling blade comprises a locking protrusion adapted to be retained in one of said recesses effective to prevent movement thereof.

10. A razor cartridge adapted to be removably replaced onto a shaving device, comprising:

a blade holder assembly having a longitudinal extent with opposing sides, a front end for engaging a shaver's face, and a rear end;

a blade holder support under the assembly for removable placement onto the shaving device;

a safety bar at the front end of the blade holder assembly;

a fixed blade mounted on the blade holder assembly rearwardly of the safety bar; and a styling blade mounted on the blade holder assembly rearwardly of said fixed blade and adapted to be slidably positionable along said longitudinal extent of said blade holder assembly and, when slid, to protrude from one or the other of said opposing sides, and when centered in said blade holder assembly the styling blade is exposed and functions as a primary shaving blade in cooperation with the fixed blade to form a twin blade razor.

11. The razor cartridge of claim 10, releasably attached to and further comprising a shaving device comprising a handle pivotally attached to a retaining mechanism assembly, the retaining mechanism assembly adapted to releasably receive the blade holder support of the razor cartridge.

12. A blade holder assembly, comprising:

a blade holder having a longitudinal extent with opposing sides, a front end for engaging a shaver's face, and a rear end;

a safety bar at the front end;

a fixed blade mounted rearwardly of the safety bar; and a styling blade mounted rearwardly of said fixed blade and adapted to be slidably positionable along said longitudinal extent of said blade holder and, when slid, to protrude from one or the other of said opposing sides, wherein said styling blade is disposed between an aperture defined by an assembly base and a slot bar of the blade holder assembly.

13. The assembly of claim 12, wherein said base comprises a plurality of motion hold recesses, and said styling blade comprises a locking protrusion adapted to be retained in one of said recesses effective to prevent movement thereof.

* * * * *